US005237375A

United States Patent [19]

Michlin et al.

[11] Patent Number: 5,237,375

[45] Date of Patent: Aug. 17, 1993

[54] WIPER AND SPREADER BLADE STIFFENER

[75] Inventors: Steven B. Michlin, 5310 Bentley Suite 105, West Bloomfield, Mich. 48322; John P. Wagnon, Lafayette, La.

[73] Assignee: Steven Bruce Michlin, West Bloomfield, Mich.

[21] Appl. No.: 883,698

[22] Filed: May 13, 1992

[51] Int. Cl.[5] ..... G03G 21/00

[52] U.S. Cl. ..... 355/299; 355/259; 118/261; 118/652; 15/256.5; 101/157; 101/169

[58] Field of Search ..... 355/299, 256, 257, 258, 355/259; 118/261, 652, 413; 15/256.51, 256.53, 256.5; 427/356; 101/157, 169

[56] References Cited

U.S. PATENT DOCUMENTS

| | | | |
|---|---|---|---|
| 3,866,266 | 2/1975 | Dunlap | 101/169 X |
| 4,264,191 | 4/1981 | Gerbasi et al. | 355/299 |
| 4,373,445 | 2/1983 | Köbler | 101/169 X |
| 4,549,933 | 10/1985 | Judd et al. | 15/256.51 X |
| 4,735,144 | 4/1988 | Jenkins | 15/256.51 X |
| 4,823,161 | 4/1989 | Yamada et al. | 15/256.5 X |
| 4,895,071 | 1/1990 | Benton | 101/169 |
| 4,978,999 | 12/1990 | Frankel et al. | 355/299 |
| 5,153,657 | 10/1992 | Yu et al. | 355/299 |

*Primary Examiner*—R. L. Moses

[57] ABSTRACT

A strip of predetermined thickness and sufficient width is attached adjacent to the edges of spreader and wiper blades used in toner cartridge assemblies for printers, copiers and facsimile machines. The strip provides heat dissipation and distortion prevention characteristics to previously manufactured spreader and wiper blades. The strip is made of heat reflective material and might be a ductile metal such as aluminum or plastic which has elastomeric properties. The strip is attached to the blade by adhesive, metal plating, or by other methods. In one embodiment the strip is placed on the blade such that it is relatively flat. In another embodiment the strip is applied to the blade such that the strip forms an upstanding lip protruding angularly from the blade adjacent to the blade's edge. The strip or lip on the blade does not contact the roller on which toner is being spread or from which toner is being wiped. The lip may have spaced openings which provide for increased rates of heat dissipation, and the openings in the lip may have different depths and widths.

10 Claims, 4 Drawing Sheets

Cross-Sectional View of the Image Formation System

WIPER AND SPREADER BLADE STIFFENER

BACKGROUND OF THE INVENTION

This invention relates to a device for the improvement of a little known imperfection in state of the art technology, which incorporates the use of dry toner devices, such as copiers, facsimile machines, laser printers and toner cartridge assemblies that are now possible to recharge when empty, rather than purchase a completely new assembly containing all new parts. Until recently, service on plain-paper copy machines, facsimile machines, and printers was very costly, which cost can now be substantially reduced because the wear parts are kept in a removable cartridge. While at the same time extending the life expectancy of the toner cartridge now, increased utility and productivity may now be achieved. This new technology is applicable to be used on both spreader and wiper blades, each of which will be slightly modified, to improve heat dissipation from generated heat during machine usage and at the same time will function, control and limit potential non-uniform distribution of toner during machine operation. Therefore, although the problems above mentioned were known, the solution was very obscure until the wear and generated heat resulting from machine operation, particularly the frictional heat from the blade doing its job, was characterized as being the problem. It was not readily resolved, because at the time the machine was being operated, it was at an elevated temperature, while component inspection was made at a time when the machine (and cartridge) was cold, since the disassembly inspection time permitted said components to cool, and when said machine operated, said components return again to elevated temperature state. This possibly explains why the solution to the above problems were not recognized.

SUMMARY OF THE INVENTION

Accordingly, having recognized the problem and its solution, it is a primary object of this invention to modify spreader and wiper blades, in a reusable toner cartridge, while at the same time installing improved replacements for the defective components without the necessity of purchasing a completely new cartridge, as in the past. The same enhancements as above may be made in machines that don't use toner cartridges, as well as other machines of different design.

Another object of the invention is to provide a remanufactured toner cartridge assembly wherein the respective components replaced will be capable of more rapid heat dissipation during usage to reduce and eliminate any warping and/or distortion of the components which create the problems encountered.

Still another object is to provide a solution wherein current production parts can be modified, both during and after usage, with a minimum service and/or parts cost, while at the same time retaining the characteristics of a new part.

Yet, still another object of the invention is that while ozone is generated while the machine is operating, it will have minimal effect on any modified thin coated parts, using a suitable material although there will be some decrease in resilience of said materials used.

BRIEF DESCRIPTION OF THE DRAWINGS

This invention, together with other objects, features, aspects, and advantages thereof, will be more clearly understood from the following description, and considered in conjunction with the accompanying drawings. From the Hewlett Packard Service Manual on the Hewlett Packard 33471 Laserjet printer.

COMPLETE DESCRIPTION OF THE PREFERRED EMBODIMENT

In the image formation system 10, it will be remembered that a laser printer requires the interaction of several different technologies, electronics, optics, electro-photographics, etc., to provide any page of quality printed output. Each process functions independently and is coordinated with each of the other respective processes. The image formation system is centered around a photo-sensitive/photo-receptor drum in six relatively independent cooperative stages, A—Cleaning, B—Conditioning, C—Writing, D—Developing, E—Transfer, and F—Fusing.

Figure 1:
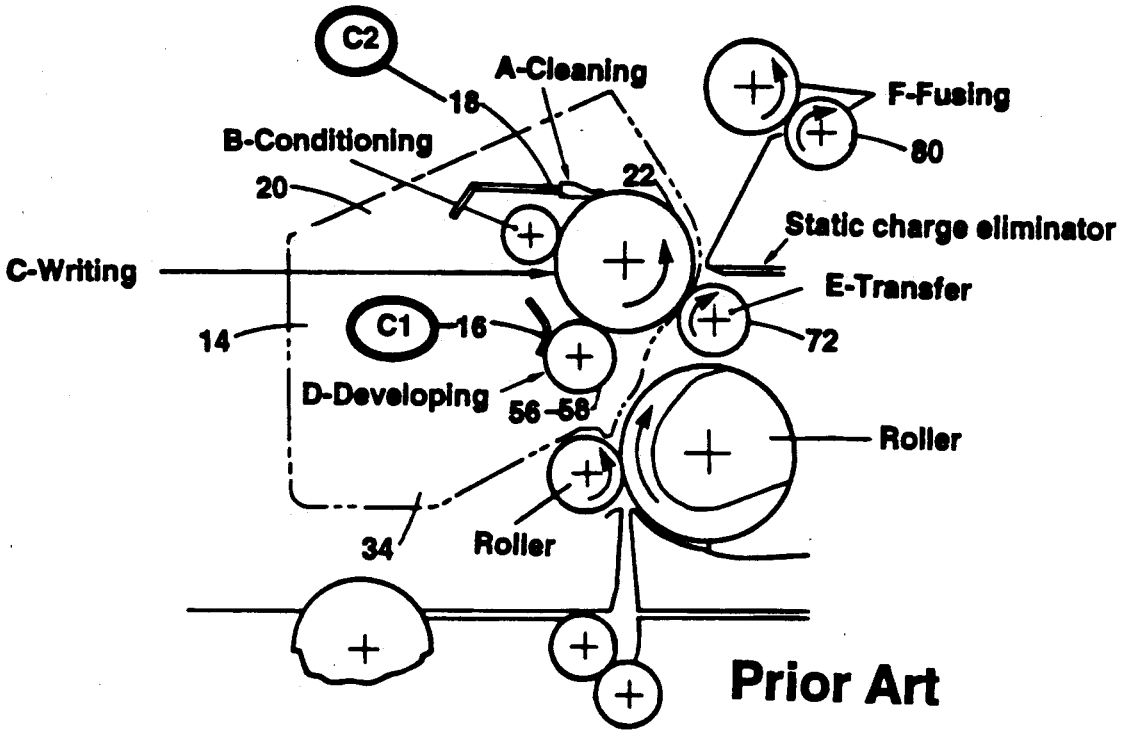
FIG. 1 illustrates prior art from with components C1 and C2 representing the modified structures.
Figure 2:
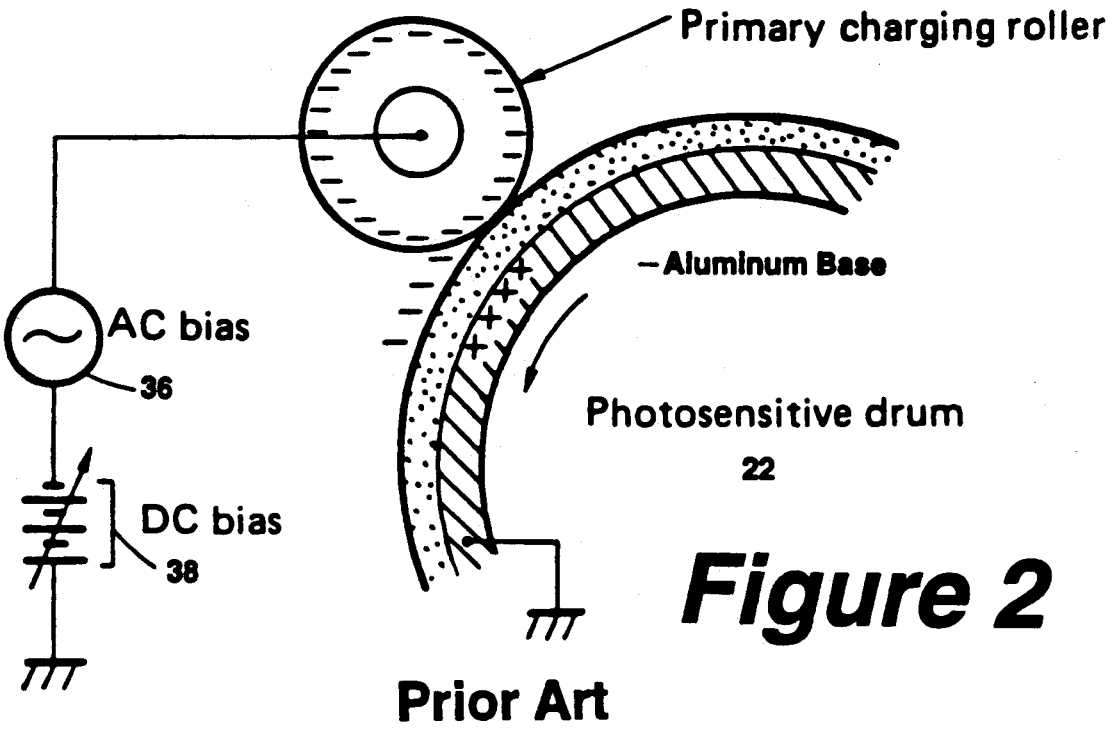
Figure 2 Prior Art
FIG. 2 illustrates the primary charging roller of the prior art.
Figure 3:
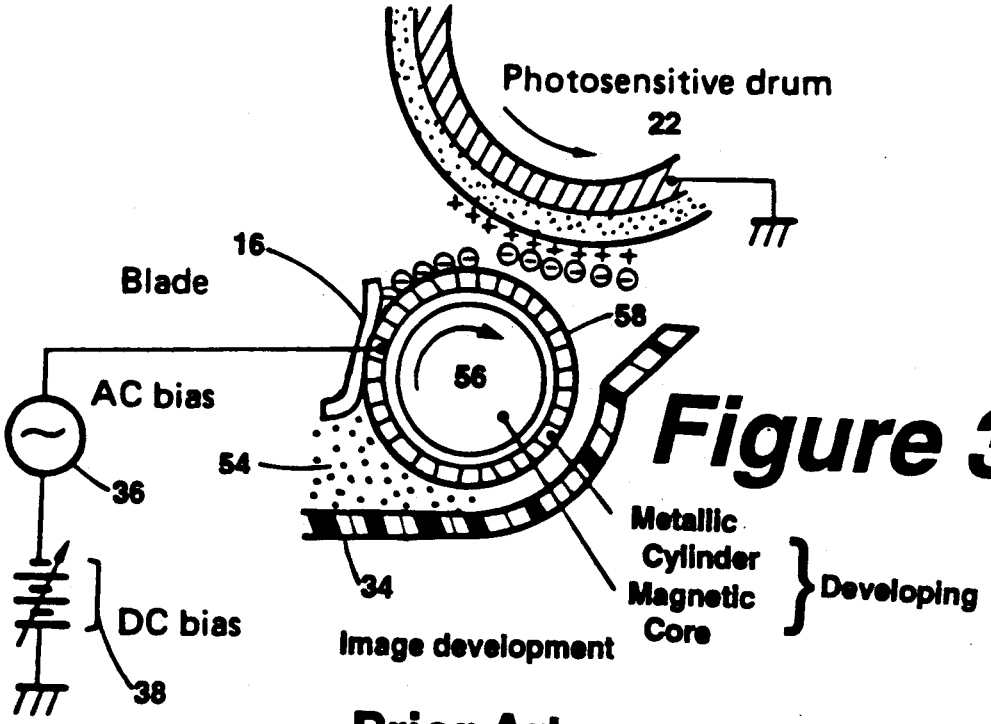
Figure 3 Prior Art
FIG. 3 is the development process from the prior art.
Figure 4:
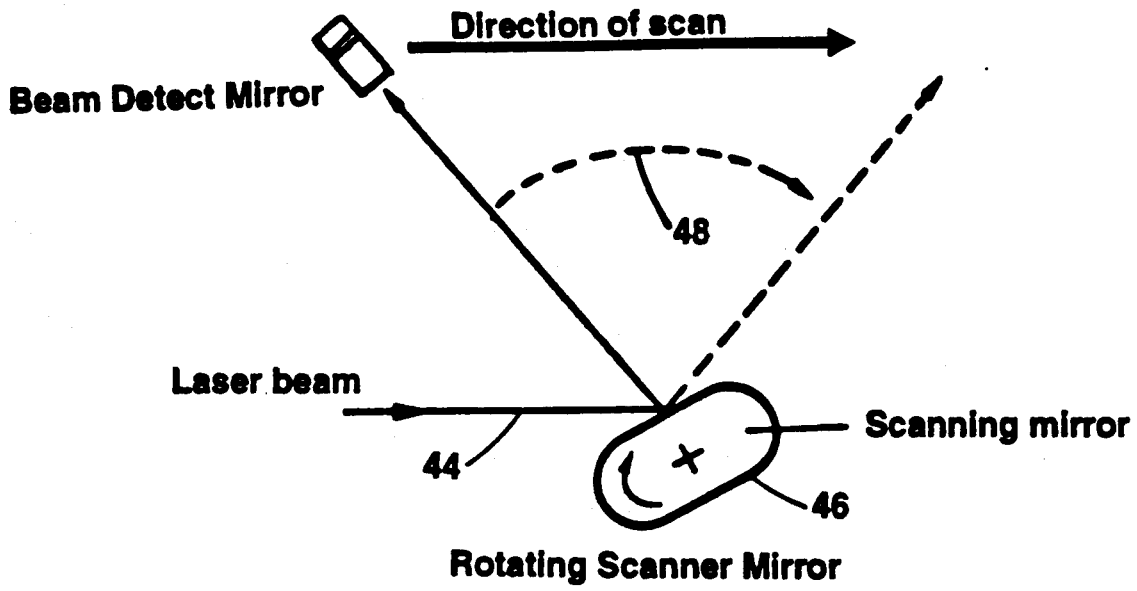
Prior Art Figure 4
FIG. 4 illustrates the rotating scanner mirror of the prior art.
Figure 5:
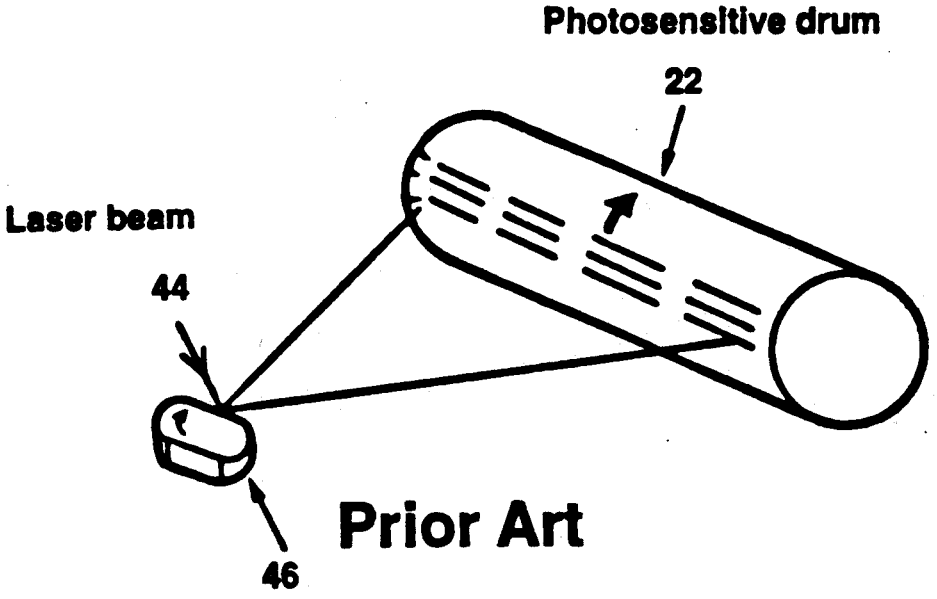
Prior Art Figure 5
FIG. 5 shows the photosensitive drum of the prior art.

Some of the processing stages are located in or immediately adjacent to the reusable cartridge 14, which is true of the spreader component #C-1, shown in FIG. 1 as 16, while the wiper component #C-2 is identified as 18, each of which will be modified in a similar manner. Since both the spreader 16 and wiper 18 are consumables, subject to wear and will degrade over both time as well as long and short term usage, which parts have been designed into and/or adjacent to the cartridge assembly 20. The cartridge assembly contains the photo-sensitive/photo-receptor drum 22, the primary charging roller 32, developer station 42, toner cavity 52, and the A-Cleaning station 62.

The photo-sensitive/photo-receptor drum 22 is the heart of the whole system, since it allows a selected image to be formed on the outer surface thereof and then transferred onto plain-paper. The drum 22 is formed from a cylinder and coated with a layer of photo-conductive material, while the base of the photo-sensitive/photo-receptor drum 22 is connected to a ground potential. The material from which the drum 22 is made is photo-sensitive/photo-receptive and when exposed to light the negative charges deposited on said drum are conducted to the ground potential of the drum's base, while areas of the drum 22, which are not exposed to light, remain non-conductive and maintain their respective negative charge. However, it is very important not to expose the drum to bright sunlight or other source of bright light, since permanent damage to the drum can result.

It will also be noted that during the cleaning stage of the image formation, the photo-sensitive/photo-receptor drum's surface is prepared to hold an image by physically cleaning the said drum During the printing process, the drum 22 is constantly rotating making several complete rotations per each printed page, before forming the image for a given section of print, any remaining toner from the previous rotation of the drum must be removed from the drum 22. The excess toner is removed using a rubber or other elastomeric wiper blade 18, after which the toner is collected and stored in the cleaner container and is prevented from leaking out of the cartridge 14 by the wiper blade 18.

After the drum 22 has been thoroughly cleaned, it must also be conditioned, which is accomplished by the application of a negative charge on the surface of said drum 22 by the primary charging roller 32 in the cartridge 14. The primary charging roller is coated with a conductive rubber that has an A-C bias 36 applied to erase any remaining residual charges to keep the potential on the photo-sensitive/photo-receptor drum 22 constant. Additionally a negative DC 38 voltage is applied by the charging roller 32 to create a uniform negative potential on the drum 22 surface, which is controlled by the print density adjustment slide.

With respect to the conventional corona charging system, the charging roller requires a lower charging voltage and this substantially decreases the amount of ozone generated by the operating printer, compared to using a corona wire.

After rotating past the conditioning station, the drum 22 will have a uniform negative potential on its surface. At the writing station C, 40, a rotating laser scanner beam 44 is used to discharge the potential to ground by focusing laser light onto pre-selected areas of the drum 22 which creates what is known as a latent electrostatic image, which is later developed into a visible image.

To explain how the laser light is controlled in order to achieve the resulting electrostatic image, laser light is produced by a small laser diode which is turned on and off by simply supplying or denying power. The direction of the laser diode is fixed. The beam 44 created thereby shines onto a rotating two sided mirror 46. As the mirror 46 rotates, the beam 44 reflects off of the mirror and sweeps (left to right) in an arcing motion.

The horizontal beam is brought into focus on said rotating drum 22 by a set of focusing lenses, the beam reaches the said drum 22 through a laser beam access slot in the side of the cartridge 14. Because the beam 44 sweeps the total length of the drum 22, the total curcumference of the drum can be covered. The sweeping action of the beam is similar to how a television sweeps its electron beam to form a video image on the screen. The speed of the scanner motor turns the two sided mirror 46 and the speed of the main motor that turns the drum are synchronized so that each successive sweep of the beam 44 is offset 1/300th of an inch. The beam can also be turned on and off to place a dot of light every 1/300th of an inch in a horizontal direction. This is how the printer functions to achieve its 300 dots per inch resolution.

At the start of each sweep before the beam reaches the drum 22, the beam is reflected off of the beam detect mirror into a fiber optics cable. Thus, as the momentary pulse of light is directed through the fiber optics cable to a DC controller where it is converted into an electric signal that is used to synchronize the output data for a single scan line sweep. This pulse will then be known as the beam detect signal, which will also be used to diagnose any problems with the laser and/or the scanner motor.

Following the writing station C, 40, the photo-sensitive/photo-receptor drum 22 will have an invisible latent electrostatic image thereon. Thus, the portions of the drum unexposed remain with a negative potential placed there by the primary charging roller, while the portions exposed to the light will have been discharged to ground, so as to form the latent electrostatic image thereon.

Therefore, at the developing station D, 42, the latent electrostatic image is converted into a visible image on the drum 22. The developing unit is in the form of a metallic cylinder 56 that rotates around a fixed magnetic core 58, disposed inside of the toner cavity 34, while a spreader blade 16 is disposed adjacent thereto. The toner in said cartridge is a black plastic resin 54 bound with iron particles. Thus, the iron in the toner 54 is attracted to the magnetic core 58 of the metallic cylinder. The spreader blade 16 controls and adjusts the quantity of toner 54 on the developing cylinder to provide a uniform deposit thickness. The toner particles receive a negative surface charge through a rubbing contact against the developing cylinder connected to a negative DC supply. The negative charge on the toner 54 creates an attraction between the toner and the grounded discharge areas of the photo-sensitive/photo-receptor drum 22 that have been subjected to the exposed laser light 44. This charge also causes the toner to be repelled from the negatively charged areas of the drum that have not been exposed to the laser light. An AC potential is also applied to the developing cylinder to decrease the attraction between the toner 54 and the magnetic core 56 of the metallic cylinder 58, and also to increase the repelling action of the toner 54 against the drum areas not exposed to the laser light. Thus, this AC potential functions to improve and control the density and contrast of the output pages.

The DC bias of the developing cylinder 58 can be adjusted to charge the force attraction between the toner 54 and the drum 22. Thus, with a change in the bias, the print density can be increased and/or decreased to have variations of approximately plus or minus ten (10%) percent.

The transfer station E, 70, is where the toner image on the drum 22 is transferred to the paper copy. A positive charge is applied to the back of the paperby the transfer roller causing the negatively charged toner 54 on the photo-sensitive/photo-receptor drum 22 surface to be attracted to the paper page. It will be noted that this transfer process requires a lower transfer voltage, and produces less ozone than the conventional "corona" method of transfer.

As the paper and drum 22 continue to move, the small radius of the drum 22 and the paper stiffness cause the paper to peel away from the drum Separation is also aided when the static charge eliminator is grounded, so that the forces between the negatively charged drum 22

(and/or photo-sensitive/photo-receptor belt) and positively charged paper are diminished. Without this condition, the paper could wrap around the drum 22. As the said drum 22 rotates, the paper moves to the fusing station F, 80, while the drum 22 rotates through the cleaning and conditioning stations A and B respectively, ready to receive the next image to be copied.

Now, with respect to the drawings, FIGS. 1-13, are exceptionally simple although the proposed structures will provide the users of electrostatic copy machines many savings, both in operational costs as well as service calls. FIGS. 1 through 5 describe the functions and operational characteristics of this type of plain paper imaging device, while FIGS. 6 through 12 delineate how once a problem is recognized, it may be possible to find a simple, cost effective solution, which is the case in the present innovation.

Figure 6:
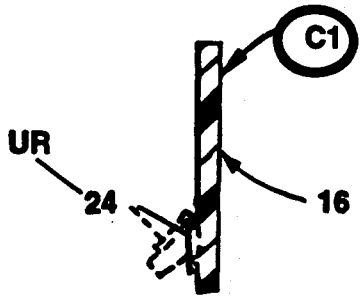
FIG. 6 is an enlarged elevational view of a modified spreader shown as component #1 in FIG. 1.
Figure 7:
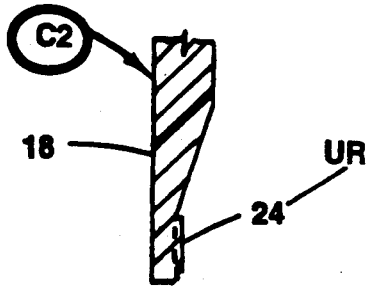
FIG. 7 is an enlarged elevational view of a modified wiper for the photosensitive drum.
Figure 8:
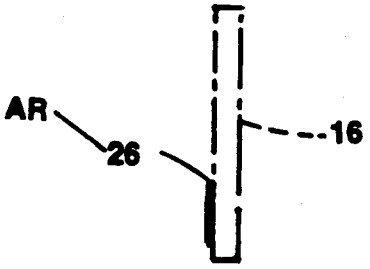
FIG. 8 is is a modified view of a unitary spreader construction (enlarged).
Figure 9:
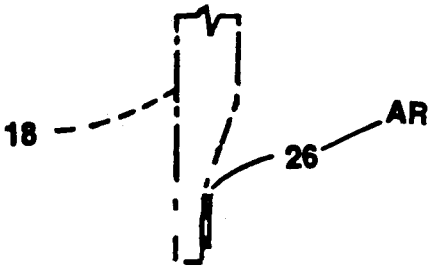
FIG. 9 is a modified view of a unitary wiper construction (enlarged).

In FIG. 6, we see a new unitary toner spreader blade 16 before assembly, wherein the said blade can be extruded, using any of several flexible plastics having both resilient as well as elastomeric properties. While these properties are not unusual, they do present a problem when wear and operational heat serve to allow the distortion of the said materials. To avoid such problems, the addition of a reinforcement 24 adjacent to the surface nearest the friction-generated heat source provides the answer. This is true for each of the diagramatic illustrations shown in the several FIGS. 6 through 12, which is a predetermined thickness and of sufficient width to eliminate any potential distortion of the blades 16, which is the spreader blade cross section shown in FIG. 1, while the same teaching is applied to the wiper blade 18, used to clean the photosensitive/photo-receptor drum 22, shown in FIG. 2. However, if we were to use blades for the same purpose of the original design provided by the manufacturer of the machine, we can modify them as shown in FIGS. 8 and 9, by the addition of an adhesively applied material 26 across the edge of either of the blades 16 or 18 with the same results. To carry this a step further, we could do the same thing, using a strip 26 of pre-determined thickness and sufficient width heat reflective material by means of an adhesive. One could also mask-off areas of the blade other than an area adjacent to the edge of the blade. A reflective material could then be applied to the unmasked-off part of the blade adjacent to its edge by a metal plating method.

The material used for the strip 26 may be cut from hard as well as soft material, from metals and plastics which are ductile and elastomeric, respectively. The object is to have the strip provide rigidity to the blade, but still allow the blade to have sufficient flexibility to withstand heat and wear without deleterious distortion of the blade. The strip could be machinable, molded, extruded, die cut, stamped, vacuum-formed, or made by other methods. The strip could be attached to the blade by metal plating, or adhesive as previously discussed & vacuum plating, riveting, welding sonically as well as by electricity and gas, etc. One device that works exceedingly well is an aluminum stripping with adhesive backing. Note that the strip 26 shown in FIGS. 8 and 9 has a rerelatively flat profile as seen from end views of the blades 16 and 18.

Figure 10:
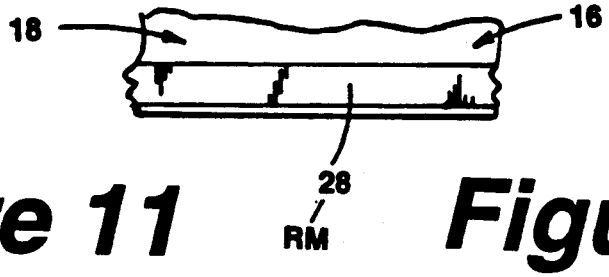
FIG. 10 is an illustration of an adhesively applied plastic reinforcement for either a spreader or wiper blade which could also be an aluminum heat reflective member.

In FIG. 10, we see a simple blade structure wherein an upstanding heat dissipating lip member thereon, and shown in elevation in FIG. The lip 28 is similar to the strip 26 except that it extends at an angle from the blade 16 or 18 rather than lying flat. While the said lip is shown as being vertical to the blade and of generally rectangular cross section, it could be of many other configurations, without departing from the spirit or scope of the invention. The lip could also be provided with a series of linear slots, along with a definite height, width, and depth, to provide the desired characteristics, including any and all of the considerations delineated in the previous Figures.

Figure 11:
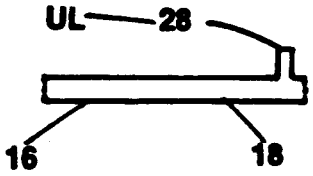
FIG. 11 is a drawing of a modified unitary spreader with an upstanding lip thereon.
Figure 12:
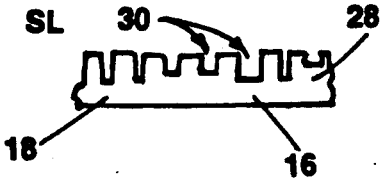
FIG. 12 is similar to FIG. 11 wherein said lip is segmented to increase the surface area exposed for faster heat dissipation.

As shown in FIG. 12, the linear slots or openings 30 are generally uniformly spaced. They may be similar or have different depths and widths on the lip as shown. The openings 30 act as cooling fins and provide for more rapid heat dissipation. The fact that the lip 28 is a strip which protrudes at an angle from the blade as shown in FIG. 11 also permits heat dissipation at an increased rate since more surface area of the strip is exposed, as compared to the flat strip 26 shown in FIGS. 8 and 9. The lip 28, like the flat strip 26, is not meant to and does not contact the rollers as toner is being spread on or wiped from the rollers by the spreader and wiper blades, respectively, during operation of the machines.

Figure 13:
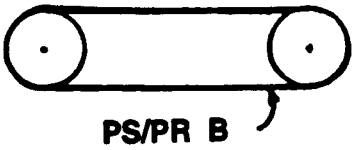
FIG. 13 shows a photo-sensitive/photo-receptor belt for replacing a photo-sensitive/photo-receptor drum.

In FIG. 13, we see a substitute for the photo-sensitive/photo-receptor drum 22, using a photo-sensitive/photo-receptor belt for the same purpose and operation in the same general manner as above described.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalants to the claimed elements.

What is claimed is:

1. A heat dissipating and distortion preventing means for wiper and spreader blades used in toner cartridge assemblies for printers, copiers and facsimile machines, said heat dissipating and distortion preventing means comprising a strip of heat reflective material attached to said blade adjacent to a wiping or spreading edge of said blade, said strip being of predetermined thickness and sufficient width to eliminate any potential distortion of the blade, said thickness of said strip being such that said strip forms an upstanding lip protruding from said blade adjacent to said wiping or spreading edge of said blade, whereby the rigidity of said blade is increased by the increase in the thickness of said blade caused by said upstanding lip, and the additional surface area provided by said lip permits heat dissipation at an increased rate.

2. A heat dissipating and distortion preventing means as in claim 1 wherein said strip is made of a material that is rigid yet has sufficient flexibility to withstand heat generated during operation of said machines without deleterious distortion of said blades.

3. A heat dissipating and distortion preventing means as in claim 2 wherein said material is plastic.

4. A heat dissipating and distortion preventing means as in claim 2 wherein said material is ductile metal.

5. A heat dissipating and distortion preventing means as in claim 4 wherein said ductile metal is aluminum.

6. A heat dissipating and distortion preventing means as in claim 5 wherein said aluminum strip is adhesively applied to said blade.

7. A heat dissipating and distortion preventing means as in claim 1 wherein said strip is attached by adhesive to said blade.

8. A heat dissipating and distortion preventing means as in claim 1 wherein said strip is formed by masking off areas of the blade other than adjacent to the edge of said blade, and then metal plating a reflective material on the unmasked-off portion adjacent to said edge of said blade.

9. A heat dissipating and distortion preventing means as in claim 1 wherein said upstanding lip has a plurality of generally uniformly spaced openings therein to provide for more rapid heat dissipation.

10. A heat dissipating and distortion preventing means as in claim 9 wherein said openings are of different depth and width.

* * * * *